US006231355B1

(12) United States Patent
Trammel et al.

(10) Patent No.: US 6,231,355 B1
(45) Date of Patent: May 15, 2001

(54) MATCHED IMPEDANCE CONNECTOR HAVING RETENTION DEVICE ON A GROUNDING PLANE

(75) Inventors: John D. Trammel, Winston-Salem, NC (US); Eric Juntwait, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/466,237

(22) Filed: Dec. 17, 1999

(51) Int. Cl.[7] ..... H01R 12/20
(52) U.S. Cl. ..... 439/79; 439/101
(58) Field of Search ..... 439/79, 63, 101, 439/108, 701, 608

(56) References Cited

U.S. PATENT DOCUMENTS 4,781,604 * 11/1988 Sadigh-Behzadi et al. ..... 439/101
5,004,427 * 4/1991 Lindeman ..... 439/101
5,199,885 * 4/1993 Korsunsky et al. ..... 439/79
5,516,307 * 5/1996 Cartesse et al. ..... 439/63

* cited by examiner

*Primary Examiner*—Gary F. Paumen
(74) *Attorney, Agent, or Firm*—Wei Te Chung

(57) ABSTRACT

An electrical connector comprises a die cast housing defining a receiving space therein. A connector insert is inserted into the receiving space and includes a first half integrally formed therewith a plurality of first terminals, and a second half mated with the first half and integrally formed with a plurality of second terminals which are symmetrically aligned with the first terminals. Each of the first and second terminals includes a body portion enclosed within the corresponding half, and a mating portion extending beyond the block and a tail portion extending opposite the mating portion. Retaining posts and recesses are formed between the first and second blocks to fixedly secure the first and second blocks together. A grounding bus is sandwiched between the first and second blocks. The ground bus includes a plurality of pin legs having a needle-eye thereon.

1 Claim, 5 Drawing Sheets

MATCHED IMPEDANCE CONNECTOR HAVING RETENTION DEVICE ON A GROUNDING PLANE

1. Field of the Invention

The present invention relates to an electrical connector, and particularly to a matched impedance connector having retention device on a grounding plane thereof.

2. Description of the Prior Art

Signal transmission with a signal line is very keen to the performance of a computer. When the signal transmission speed becomes faster and faster, EMI shielding becomes more and more important to prevent cross talk between two adjacent signal lines. For example, the conventional flat flexible cable (FFC) is configured with a plurality of conductive wires which are connected side-by-side. In order to prevent the cross talk between two adjacent conductive wires, every two conductive wires are spaced by a ground conductive wire.

U.S. Pat. No. 5,199,885 discloses a certain type of connector (tradename: MICTOR, manufactured by AMP Incorporated) which can be used with a micro-coaxial cable. The Mictor connector contains two rows of signal contacts and a grounding bus is disposed therebetween. The Mictor connector can be arranged to 1) a straddle-mount type; and 2) vertical mount for different application. The straddle-mount connector can be used to connect with a micro-coaxial cable, while the vertical type is mounted on a printed circuit board for mating with a complementary Mictor connector. Generally, the vertical type Mictor connector includes a plurality of terminal tails extending in a direction parallel to the printed circuit board, while the grounding legs extend perpendicular to the printed circuit board.

While performing surface mount process to the vertical type connector, the terminal tails shall be accurately aligned with conductive leads on the printed circuit board. In addition, the connector shall be fixedly positioned to ensure the alignment between the high-density terminal tails and the conductive leads.

In addition, coplanarity of the terminal tails of the terminals is also vital to the surface mount process. If the terminal tails are not coplanar, defective connections will be experienced.

SUMMARY OF THE INVENTION

An objective of this invention is to provide an electrical connector with improved retention device for accurately and fixedly positioning the connector on a printed circuit board during reflowing process.

In order to achieve the object set forth, an electrical connector in accordance with the present invention comprises a die cast housing defining a receiving space therein. A connector insert is inserted into the receiving space and includes a first half integrally formed therewith a plurality of first terminals, and a second half mated with the first half and integrally formed with a plurality of second terminals which are symmetrically aligned with the first terminals. Each of the first and second terminals includes a body portion enclosed within the corresponding block, and a mating portion extending beyond the block and a tail portion extending opposite the mating portion. Retaining posts and recesses are formed between the first and second blocks to fixedly secure the first and second blocks together. A grounding bus is sandwiched between the first and second blocks. The ground bus includes a plurality of pin legs having a needle-eye thereon.

These and additional objects, features, and advantages of the present invention will become apparent after reading the following detailed description of the preferred embodiments of the invention taken in conjunction with the appended drawings.

DETAILED DESCRIPTION OF PREFERRED EMBODIMENTS

Figure 1:
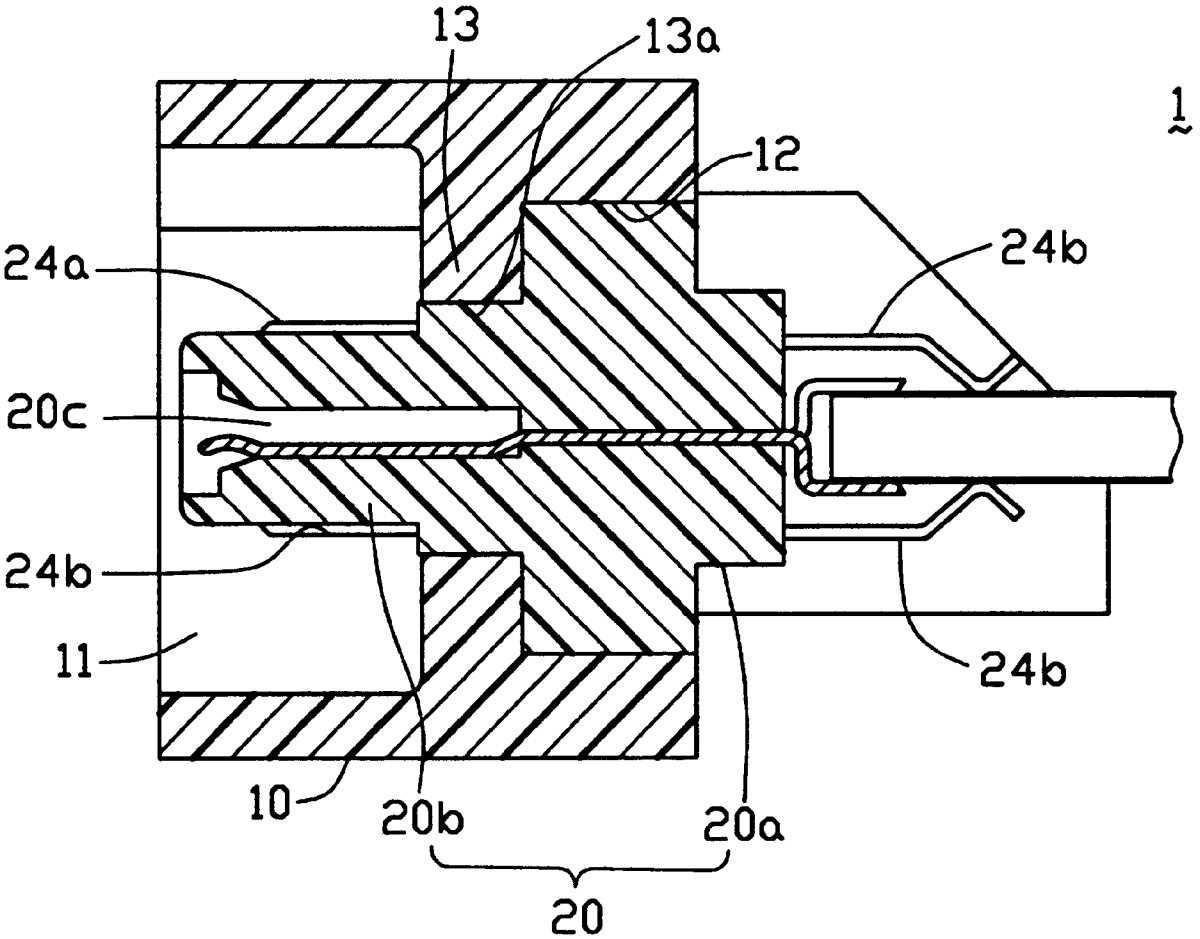
FIG. 1 is similar to FIG. 1 with the connector assembled to a printed circuit board.
Figure 2:
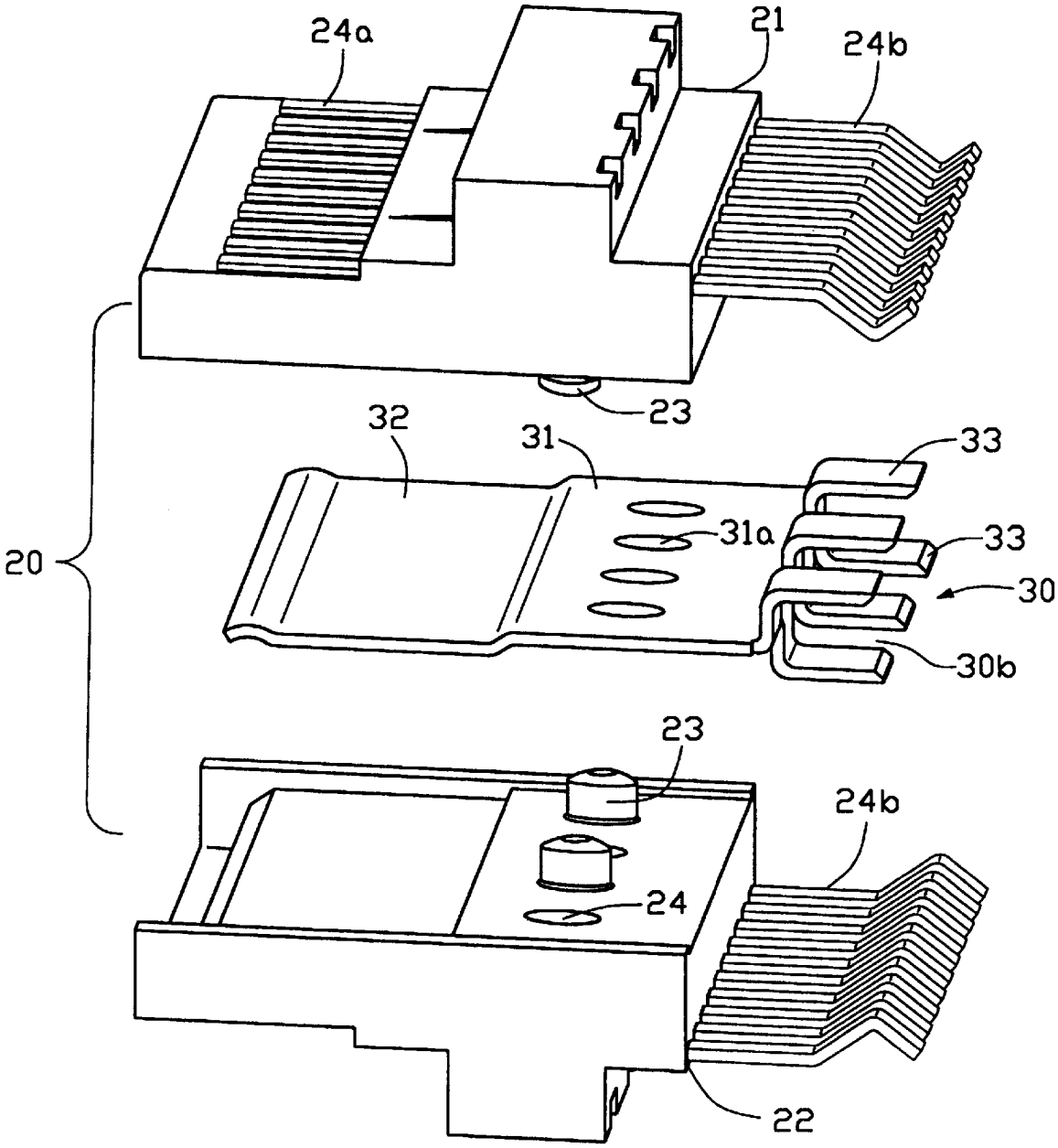
FIG. 2 is a perspective view of a connector insert of the connector of FIG. 1.
Figure 3:
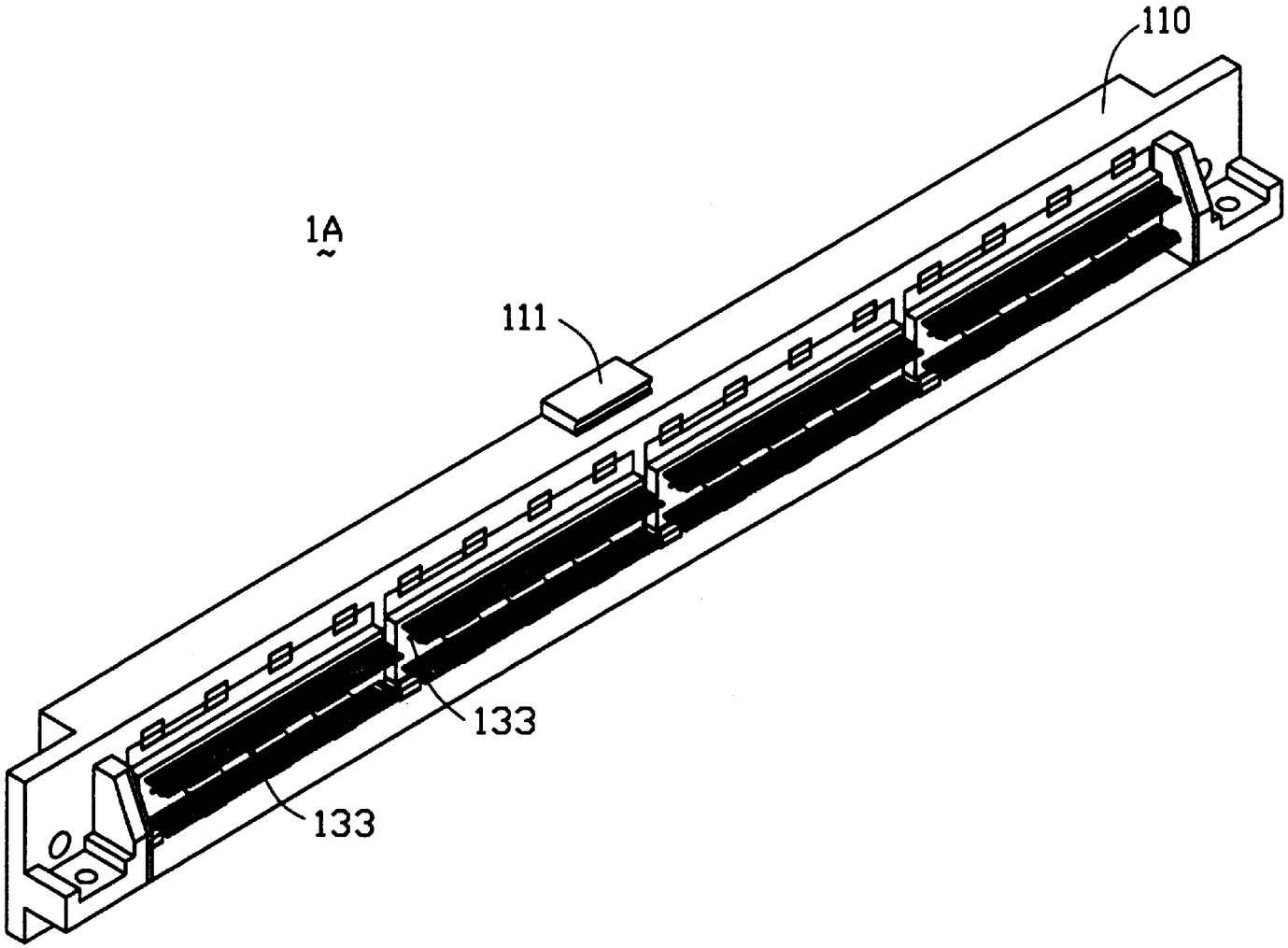
FIG. 3 is a perspective view of a connector with a second variation of a grounding bus in accordance with the present invention.

Referring to FIGS. 1, 2 and 3, a connector 1 in accordance with the present invention comprises a housing 10 defining first and second receiving chambers 11, 12 divided by a partitioning wall 13 arranged therebetween. An opening 13*a* is defined in the partitioning wall 13. The first receiving chamber 11 is used to receiving a mating portion of a complimentary connector (not shown), while the second receiving chamber 12 is used to fixedly retain the connector insert 20 therein.

The connector insert 20 includes upper and lower halves 21, 22 assembled by posts 23 and recesses 24 arrangement. The connector insert 20 includes a base portion 20*a* fixedly retained in the second receiving chamber 12, and a tongue portion 20*b* extending through the opening 13*a* and into the first receiving chamber 11. The upper and lower halves 21, 22 further defines a slit 20*c* therebetween for insertion of a complementary grounding element (not shown). Each half 21, 22 is integrally formed with a plurality of terminals 24 with a mating portion 24*a* exposed on the tongue portion 20*b* of the connector insert 20. Each terminal 24 further includes a tail 24*b* extending beyond the connector insert 20.

A grounding bus 30 is arranged between the upper and lower halves 21, 22. The grounding bus 30 includes a body portion 31 having a plurality of holes 31*a* aligned with the posts 23 of the halves 21, 22. The grounding bus 30 further includes a mating section 32 for electrically engaging with the grounding element of the complimentary connector. The grounding bus 30 further includes a plurality of tails 33 alternatively arranged such that a slot 30*b* is defined between opposite tails 33. Accordingly, an edge of a printed circuit board 40, FIG. 1, can be securely inserted therein. After the grounding bus 30 is assembled to the upper and lower halves 21, 22 to form the connector insert 20, the later is in turn inserted into the housing 10 wherein the tongue 20*b* extends into the first chamber 11, while the base portion 20*a* is fixedly retained within the second chamber 12, as what shown in FIG. 1.

FIG. 3 is a perspective view of a connector 1A in accordance with the present invention and the grounding bus 130 assembled thereto has a wider tail portion 133. In this variation, the housing 110 is provided with a key 111 which works as an anti-orientation device when mating with a complimentary connector.

Figure 4:
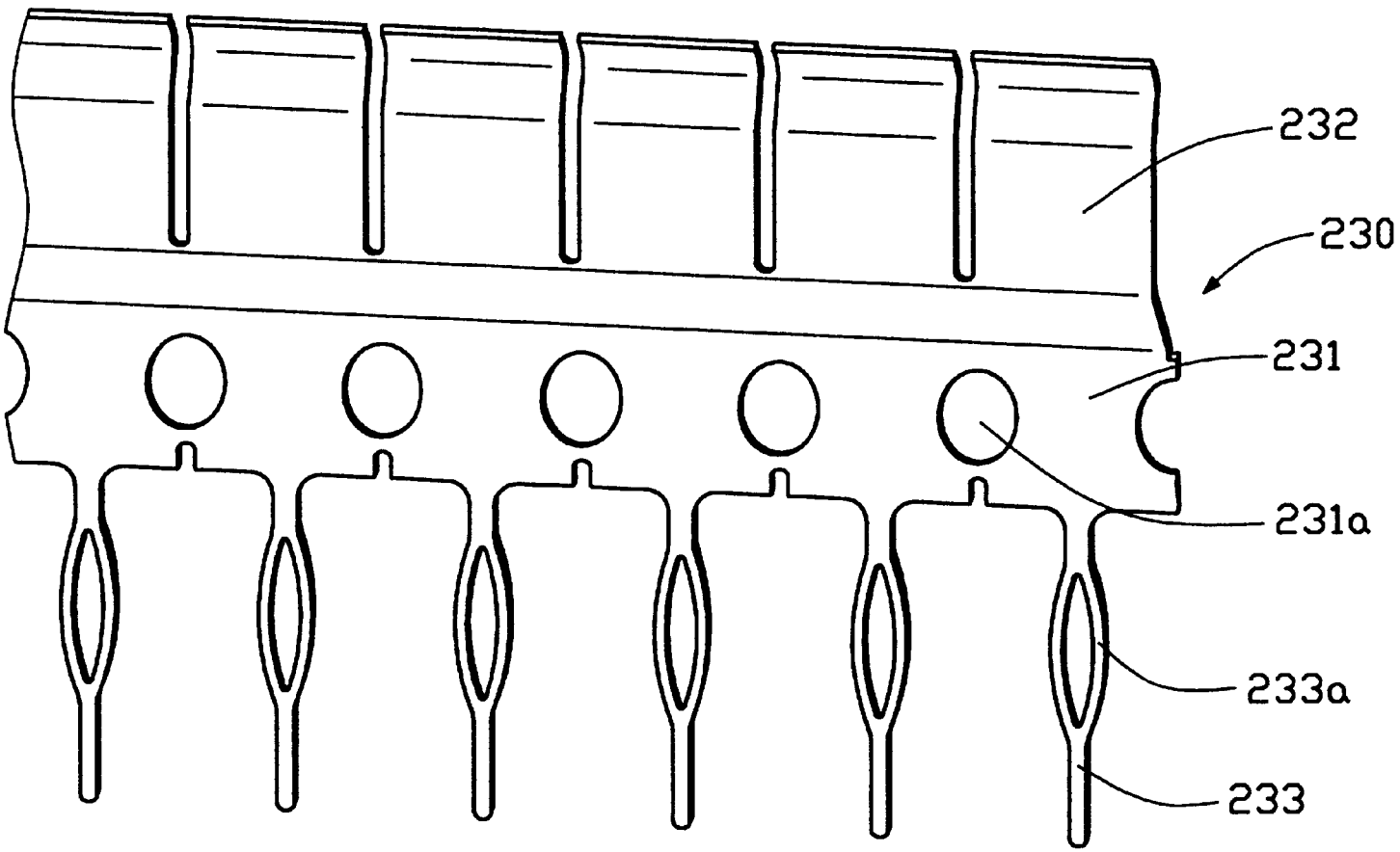
FIG. 4 is a third variation of a grounding bus in accordance with the present invention.
Figure 5:
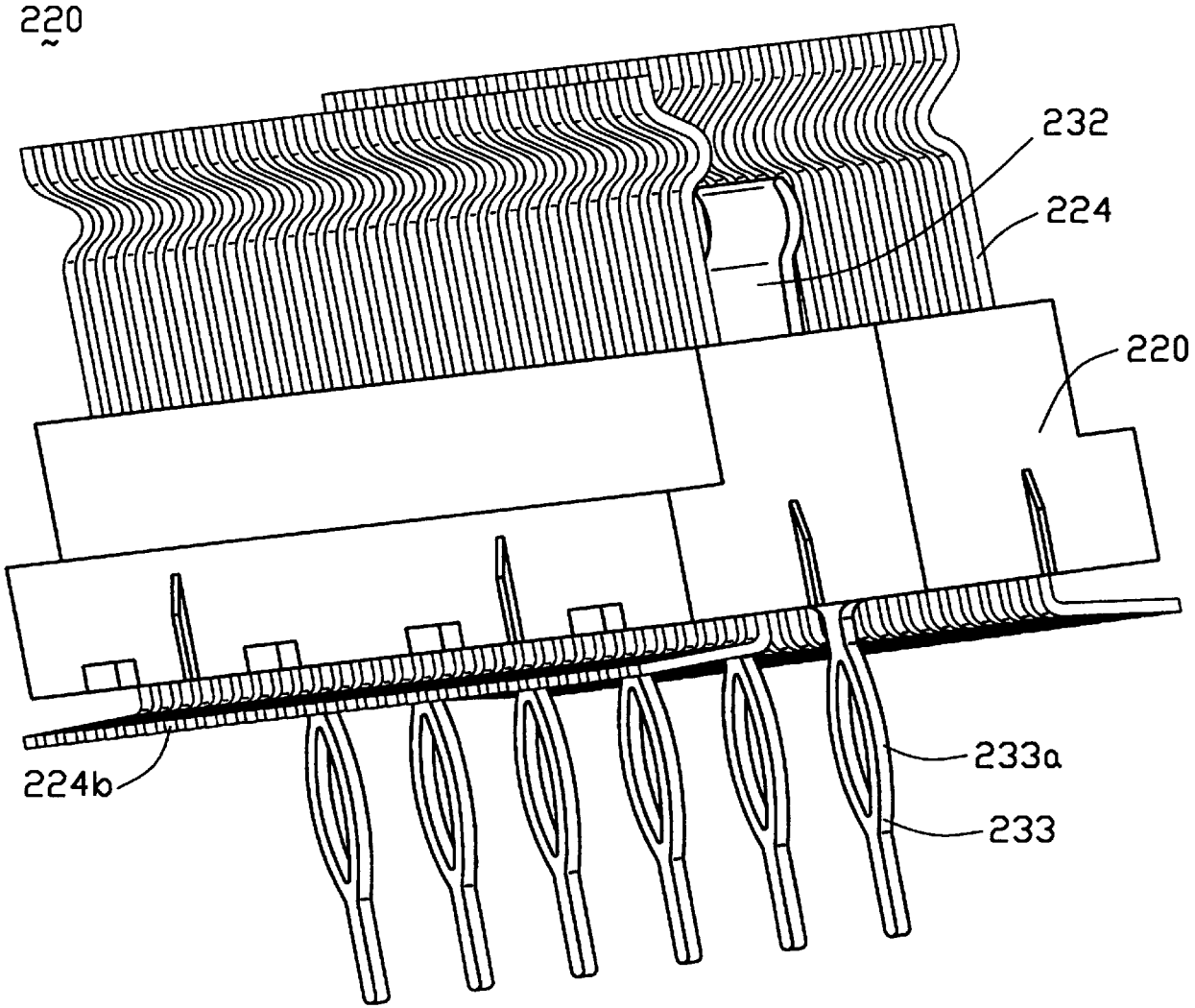
FIG. 5 is a perspective view of a connector insert with the grounding bus of FIG. 4.

FIGS. 4 is a perspective view of a third embodiment of a grounding bus 230 in accordance with the present invention, while FIG. 5 shows a perspective view of a connector inert 220 incorporated with the grounding bus 230 of FIG. 4.

The grounding bus 230 includes a body portion 231 having a plurality of holes 231*a* thereof. A plurality of mating section 232 extends from the body portion 231 for mating with a complimentary grounding element (not shown). As shown in FIG. 5, the connector insert 220 is used for surface mounting to a printed circuit board (not shown), accordingly, the tail portion 224*b* of the terminal 224 extends in a direction perpendicular to the grounding bus 230. In order to provide a secured retention to the printed circuit board, the grounding bus 230 includes a plurality of pin legs 233 each having a needle-eye portion 233*a* for providing a press-fit engagement with a corresponding through hole defined in the printed circuit board. By this arrangement, the soldering process of the surface mount connector (not shown) can be smoothly performed.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An electrical connector, comprising:

a metal die cast housing defining first and second receiving chambers divided by a partitioning wall arranged therebetween;

a connector insert inserted into said housing and including first and second discrete halves forming a base portion fixedly retained in said second receiving chamber and a tongue portion extending into said first receiving chamber through an opening defined in said partitioning wall, each half having a plurality of terminals embedded therein, each terminal including a base portion enclosed within said half, a mating portion exposed at said tongue, and a tail portion extending beyond said half;

a grounding bus fixedly arranged between said first and second halves and including a base portion sandwiched between said first and second halves, a mating portion extending into said slit located in said slit of said connector insert, and a tail section extending beyond said connector insert;

engaging means between said first and second blocks to fixedly secure said first and second blocks together; and anchoring means arranged on said tail section of said grounding bus;

wherein said tail section includes a plurality of pin legs;

wherein said anchoring means is needle-eyes formed on each of said pin legs;

wherein said anchoring means also includes a plurality of retention legs arranged alternatively and opposite from said base portion of said ground bus;

wherein a key is formed on said housing as an anti-disorientation device.

* * * * *